US009290032B2

(12) United States Patent
Peleman

(10) Patent No.: US 9,290,032 B2
(45) Date of Patent: Mar. 22, 2016

(54) METHOD FOR BINDING LEAVES AND A BINDING ELEMENT AND BINDING DEVICE APPLIED THERETO

(75) Inventor: Guido Peleman, Antwerp (BE)

(73) Assignee: UNIBIND LIMITED, Nicosia (CY)

( * ) Notice: Subject to any disclaimer, the term of this patent is extended or adjusted under 35 U.S.C. 154(b) by 91 days.

(21) Appl. No.: 14/349,435

(22) PCT Filed: Sep. 10, 2012

(86) PCT No.: PCT/IB2012/001727

§ 371 (c)(1),
(2), (4) Date: Apr. 3, 2014

(87) PCT Pub. No.: WO2013/050843

PCT Pub. Date: Apr. 11, 2013

(65) Prior Publication Data

US 2014/0248107 A1 Sep. 4, 2014

(30) Foreign Application Priority Data

Oct. 7, 2011 (BE) ..... 2011/0589

(51) Int. Cl.

| | |
|---|---|
| ***B42C 11/02*** | (2006.01) |
| ***B42C 11/04*** | (2006.01) |
| ***B42C 9/00*** | (2006.01) |
| ***B42D 3/00*** | (2006.01) |
| *B42B 5/06* | (2006.01) |
| *B42D 1/04* | (2006.01) |

(52) U.S. Cl.

CPC ..... *B42C 9/0068* (2013.01); *B42C 9/0056* (2013.01); *B42C 11/02* (2013.01); *B42C 11/04* (2013.01); *B42D 3/002* (2013.01); *B42B 5/06* (2013.01); *B42D 1/04* (2013.01)

(58) Field of Classification Search

CPC ..... B42C 11/02; B42C 11/04

USPC ..... 412/8, 37, 900, 902

See application file for complete search history.

(56) References Cited

U.S. PATENT DOCUMENTS

| | | | | |
|---|---|---|---|---|
| 4,141,100 | A * | 2/1979 | Domroe | B42C 9/00 412/902 |
| 5,066,182 | A * | 11/1991 | Stonebraker | B42B 5/00 412/17 |
| 5,219,453 | A * | 6/1993 | Furukawa | B42C 9/0056 412/21 |
| 5,425,554 | A | 6/1995 | Lamanna | |
| 5,733,087 | A * | 3/1998 | Gwyn | B42D 3/002 412/900 |
| 7,823,927 | B2 * | 11/2010 | Hoarau | B42F 9/008 402/500 |

FOREIGN PATENT DOCUMENTS

| | | |
|---|---|---|
| GB | 1 443 011 | 7/1976 |

OTHER PUBLICATIONS

International Search Report dated Dec. 3, 2012, corresponding to PCT/IB2012/001727.

* cited by examiner

*Primary Examiner* — Kyle Grabowski
(74) *Attorney, Agent, or Firm* — Young & Thompson

(57) ABSTRACT

Method for binding a bundle of leaves (11) in a binding element (1) with a U-shaped back (2) with a base (3) and upright arms (4) and a hot-melt adhesive (8) in the back, includes introducing the bundle in the back (2), and then heating up the back (2) to melt the hot-melt adhesive (8), wherein an oversized binding element (1) is chosen in which the bundle (11) is received with a certain sideways play (C), and the binding element (1) with the hot-melt adhesive (8) in the molten state is placed between two parallel pressure bars (17) that are moved towards one another with a force in order to fold the arms (4) towards one another.

15 Claims, 7 Drawing Sheets

METHOD FOR BINDING LEAVES AND A BINDING ELEMENT AND BINDING DEVICE APPLIED THERETO

A method for binding leaves and a binding element and binding device applied thereto.

The present invention relates to a method for binding leaves and a binding element and binding device applied thereto.

For binding it is known to make use of a conventional binding element in the form of a folder with a U-shaped back with a base and two upright arms and two cover sheets that are each connected by an edge to an edge of one of the arms of the back, whereby the inside of the back, more specifically at least a part of the base of the back, is provided with a hot-melt adhesive.

Hot-melt adhesive here means an adhesive that is hard at room temperature and which becomes liquid upon heating, and after cooling to room temperature becomes hard again.

In order to bind a bundle of loose leaves, a free edge to be bound of the bundle is pushed into the back up against the hot-melt adhesive, and the folder is placed, with its back downwards, on a heating element of a binding device provided to this end, in order to raise the hot-melt adhesive to a sufficiently high temperature to melt the adhesive.

The leaves of the bundle thus sink as it were, with the aforementioned edge to be bound, into the molten hot-melt adhesive.

Then the back of the binding element with the bundle of leaves in it is allowed to cool, such that the hot-melt adhesive solidifies again and the leaves are as it were bonded to the base of the back.

A problem that arises is that during binding not all the leaves of the bundle sink into the molten adhesive, or do not sink in sufficiently deeply, in order to obtain a good bond. This problem primarily occurs with the outermost leaves of the bundle, possibly because when securing the folder in the device they are somewhat held back by the cover sheets that are held together by the user in order to secure the folder to the bundle therein.

Another problem is that preferably a relatively large number of different sizes of back widths of the binding elements must be kept in stock.

Indeed, a good binding result is only obtained if the thickness of the bundle of leaves to be bound fits relatively closely between the arms of the back.

For a given thickness of a bundle, a binding element is thus chosen with a suitable back width.

With the known binding systems of the aforementioned type 12 sizes of back widths are available are example, from 1 mm to 36 mm, each with a few millimetres difference between successive sizes.

In the absence of the right size of back width, it is sometimes attempted to resort to a back with an oversized back width whose opening between the arms of the back is then artificially narrowed by squeezing the ends of the arms partly closed.

However, this rarely or never leads to a satisfactory result as it is difficult to squeeze the arms closed uniformly, and moreover the base of the back becomes bulbous as a result, such that the contact with the heating element of the binding device is not optimum, resulting in a poor bond.

The purpose of the present invention is to provide a solution to at least one of the aforementioned and other disadvantages.

To this end the invention concerns a method for binding a bundle of leaves in a binding element in the form of a folder with a U-shaped back of a pliable and thermally conductive material, preferably steel, with a base and two upright arms and two cover sheets that are each connected by an edge to a free edge of the arms, whereby a hot-melt adhesive is provided on the inside of the back, at least on a part of the base of the back, and whereby the method consists of introducing the bundle of leaves, with the edge to be bound against the hot-melt adhesive in the back, and then heating up the back to melt the hot-melt adhesive, characterised in that an oversized binding element is chosen in which the bundle with the thickness of the edge to be bound is received with a certain sideways play between the arms of the back, and that the folder with the bundle therein and the hot-melt adhesive in the molten state, is placed with the base of the back on a seat that fits closely to the base with the arms between two parallel pressure bars that are moved towards one another with a force in order to press the base of the back against the seat and at the same time to fold the arms symmetrically towards one another at an angle with respect to the base until the bundle, with a desired force from the pressure bars, is clamped in between the arms of the back, after which the pressure bars, possibly after a short period during which the force has been maintained, are again moved away from one another in order to be able to remove the bound folder, whereby the desired force is chosen such that by clamping in the bundle a force is exerted on the bundle that is directed towards the base of the back.

An advantage is that when folding the arms of the back, the free ends of the arms and the cover sheets of the binding element attached thereto are moved closer to the back, whereby these ends and/or cover sheets pull the bundle, and in particular the outermost leaves of the bundle, towards the back and the edge to be bound of the bundle is thereby firmly pushed into the molten adhesive, whereby it is guaranteed, that after the adhesive has cooled, all leaves are firmly secured in the adhesive.

Another advantage is that when clamping in the back it is perfectly secured in its place on the seat, which fosters the symmetrical squeezing close of the arms of the back.

An advantage of this symmetry is of an aesthetic nature.

Another advantage of the method is that the back fits perfectly with the clamped bundle, and there is thus no gap between the free ends of the arms through which the adhesive could be seen in the back, which also contributes to the professional appearance of the bound folder.

Another important advantage is that bundles of different thicknesses can be bound in the same binding element, so that the entire range of the usual bundle thicknesses can be bound with a limited number of sizes of binding elements.

By using the force as a control parameter of the method, the method is independent of the thickness of the back of the chosen binding element, such that an extra adjustment is not required whenever different sizes of folders are used.

The invention also relates to a binding device for use in the method as described above, whereby the device is provided with a seat for the close-fitting support of the base of the back of a folder to be bound that is placed with this base on the seat, two parallel pressure bars that extend on either side of the seat and above the level of the seat, and means for moving the pressure bars towards one another with a certain force in order to fold the arms of the back of the folder on the seat towards one another symmetrically at an angle with respect to the base. Means for determining the force exerted by the pressure bars and means to again move the pressure bars away from one another when the thus determined force has reached a certain desired value, possibly after this force has been maintained for a short period.

This device has the advantage that the arms are folded perfectly symmetrically and that the device does not require any adjustment, not even when different sizes of binding elements are used after one another.

The invention also relates to a binding element in the form of a folder that is suitable for use in a method and with a binding device as described above, and this binding element is constructed in the form of a folder with a U-shaped back of a pliable and thermally conductive material, preferably steel, with a base and two upright arms and two cover sheets that are each connected by an edge to a free edge of the arms, whereby a hot-melt adhesive is provided on the inside of the back, at least on a part of the base of the back, characterised in that the arms of the binding element are of such a height that the free ends of the arms can be folded against one another, when they are folded towards one another symmetrically over an angle with respect to the seat.

Such a binding element offers the advantage that very thin bundles can also be bound, irrespective of the width of the back of the chosen binding element.

Thus for example with a binding element with a back width of approximately 15 mm and a height of the arms of the back of approximately 10 to 11 mm, 90% of the commonest thicknesses of the bundles of leaves to be bound can be bound with a single size of binding element.

With the intention of better showing the characteristics of the invention, a preferred embodiment of a binding element and binding device according to the invention, and this for the application of a method according to the invention, is described hereinafter by way of an example, without any limiting nature, with reference to the accompanying drawings, wherein:

FIG. 1 schematically shows a cross-section of binding element according to the invention;

FIG. 4 is an enlargement of the part indicated in FIG. 3 by F4;

Figure 8:
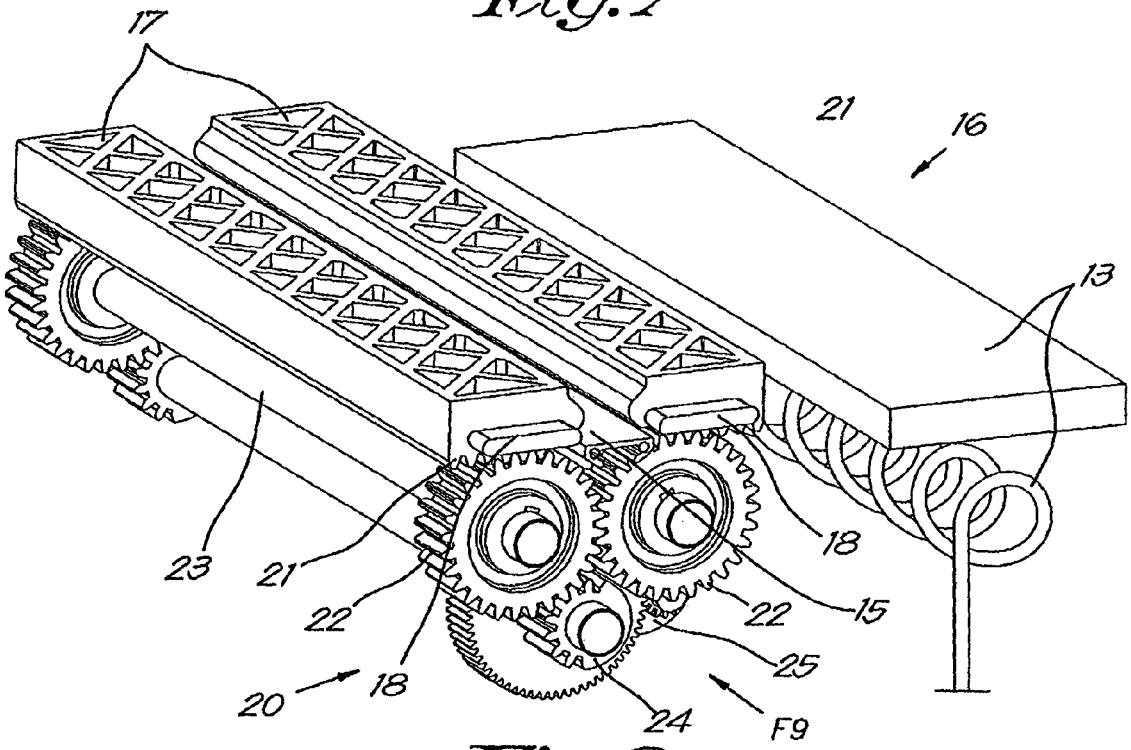
Figure 9:
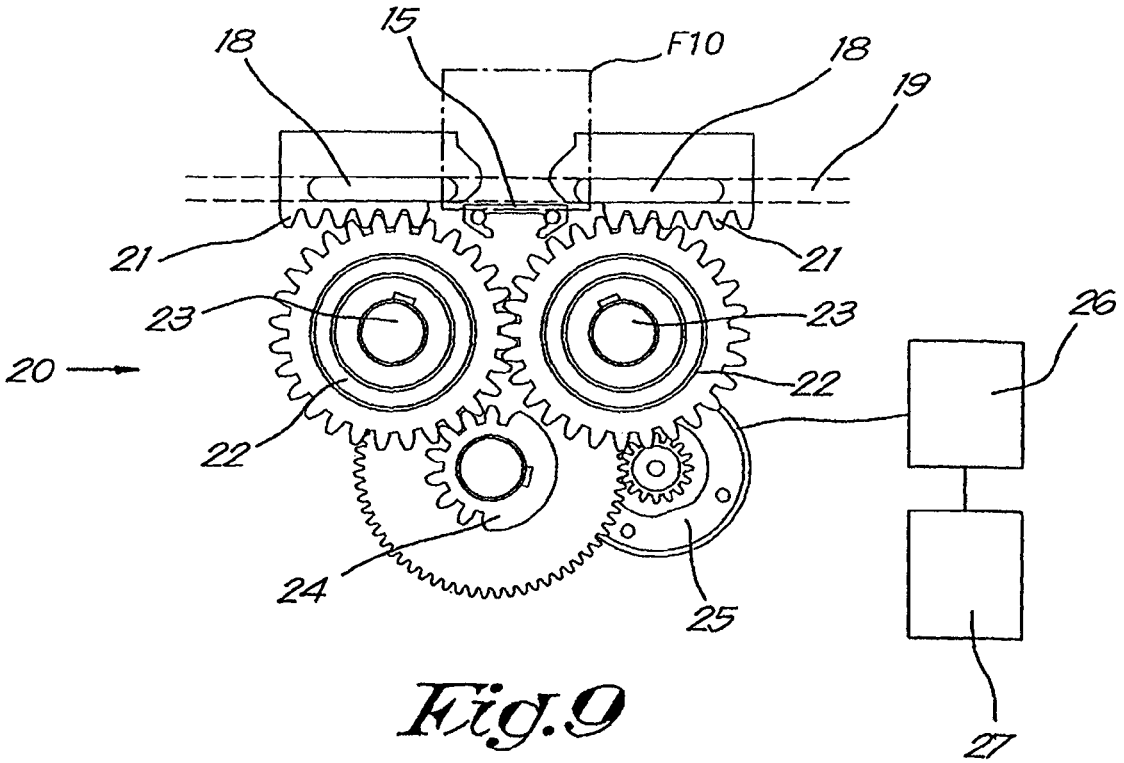
Figure 10:
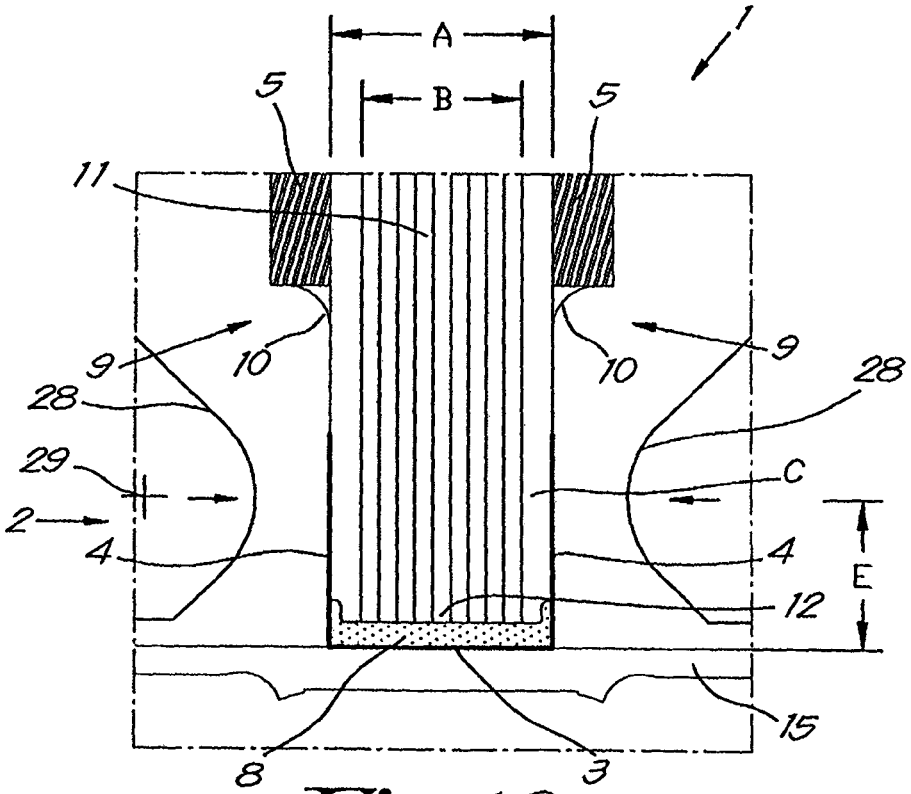

FIG. 8 schematically shows a perspective cutaway view of a binding device according to the invention for application of a method according to the invention;

FIG. 9 shows a side view according to arrow F9 in FIG. 8;

FIG. 10 shows the part indicated in FIG. 9 by box F10 on a larger scale;

FIGS. 11 to 14 show successive steps of the use of the binding device according to FIGS. 8 to 10 for application of the method according to the invention.

Figure 1:
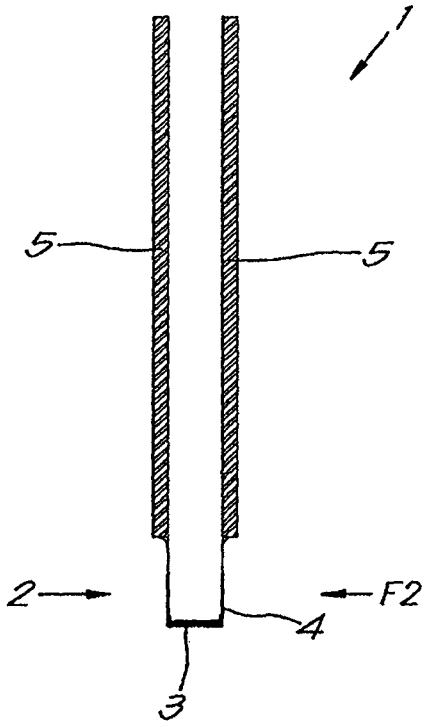
Figure 2:
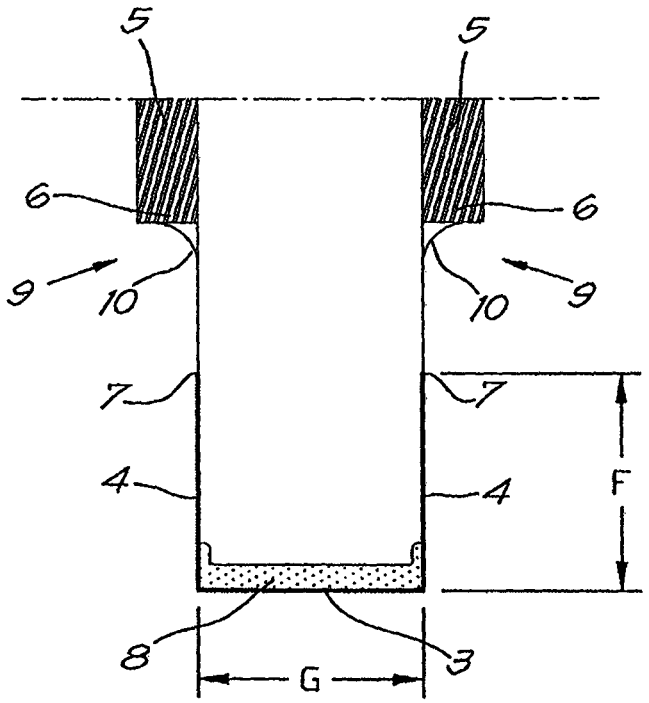
FIG. 2 shows the part indicated in FIG. 1 by F2 on a larger scale.

The binding element 1 of FIG. 1 primarily consists of a folder with a U-shaped back 2 that is manufactured from a pliable, more specifically a plastically pliable, and thermally conductive material, preferably steel, with a base 3 and two upright arms 4 and two cover sheets 5 that are each connected by an edge 6 to a free edge 7 of the arms 4.

The binding element 1 is provided with a hot-melt adhesive 8 on the inside of the back 2, in particular at least on a part of the base of the back 3.

The hot-melt adhesive 8 in the back 2 preferably extends over almost the entire length of the back, and in the example shown extends to the inside of the arms 4, although this is not strictly necessary.

In this case the cover sheets 5 are connected to the arms 4 of the back 2 by a film hinge 9, which is formed for example by a covering 10 that is affixed around the cover sheets 5 and which runs up to the back 2 on which the covering is secured, for example because it goes around the back 2 and is bonded to it, for example by means of a cold-set adhesive.

Generally the back 2 of the binding element 1 is manufactured from metal, preferably steel, or another material that is thermally conductive to efficiently and evenly distribute the heat of the binding device over the material of the back 2 as well as over the hot-melt adhesive 8.

In the example shown, the base 3 of the back 2 is constructed flat.

The use of the binding element 1 described above for the application of the method according to the invention is illustrated on the basis of FIGS. 3 to 6.

According to the invention an oversized binding element 1 is hereby assumed with a width of the back 2 that is such that the distance A between the arms of the back is greater, for example at least 4 mm greater, than the thickness B of a bundle of loose leaves 11 to be bound.

Figure 3:
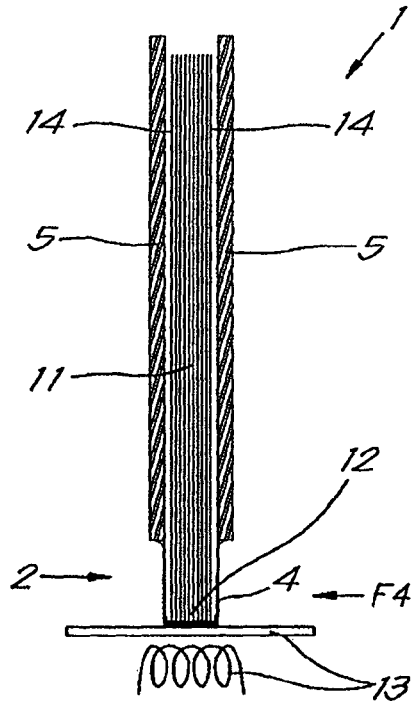
FIGS. 3 to 6 show successive steps during the binding of a bundle of leaves according to the method of the invention, in a binding element according to FIG. 1, whereby

FIG. 3 starts with a situation in which the bundle of loose leaves 12 to be bound is introduced between the cover sheets 5 of the binding element 1.

The edge 12 to be bound of the bundle 11 is thereby introduced in the back 2 with a certain sideways play C, due to the oversized choice of the binding element 1, and is thereby in contact with the hot-melt adhesive 8.

The binding element 1 with the bundle 11 in it is placed upright with the base 3 of the back 2 on a heating element 13 that is suitable for heating the back 2 and the aforementioned edge 12 of the bundle 11 to a sufficiently high temperature in order to melt the hot-melt adhesive 8.

Figure 4:
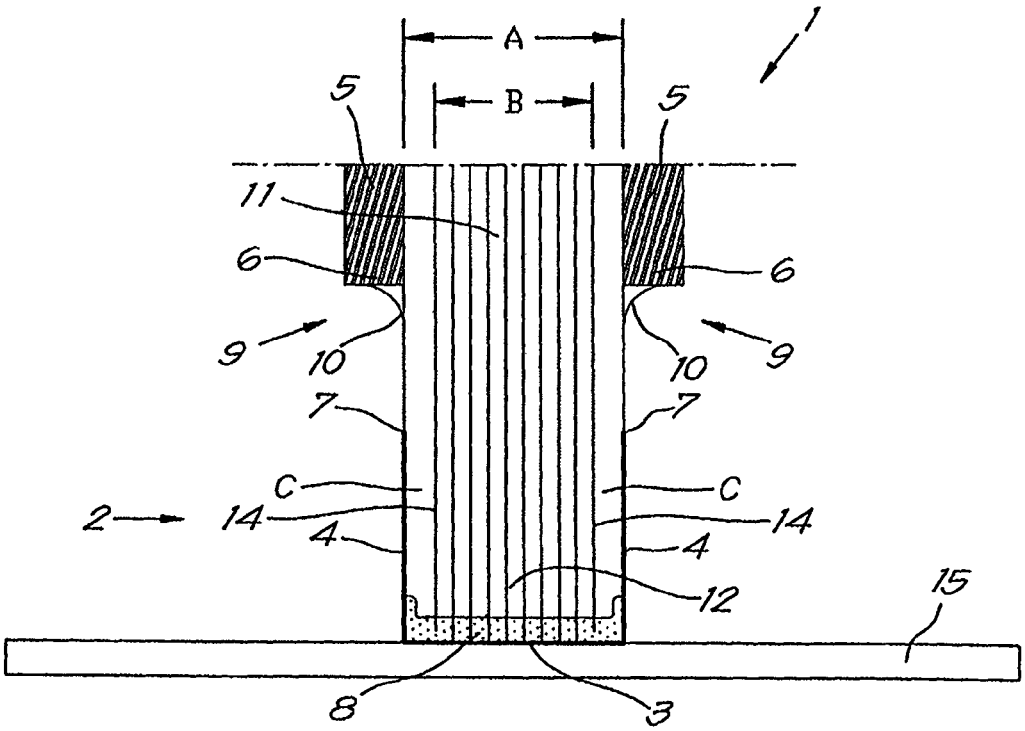

When the hot-melt adhesive 8 is molten, the edge 12 of the bundle of leaves 11 to be bound sinks into the molten adhesive 8, whereby it often occurs, as shown in FIG. 4, that the outermost leaves 14 of the bundle 11 do not sink, or do not sink sufficiently deeply, into the hot-melt adhesive 8, possibly because they are somewhat held back by the contact with the cover sheets 5.

Figure 5:
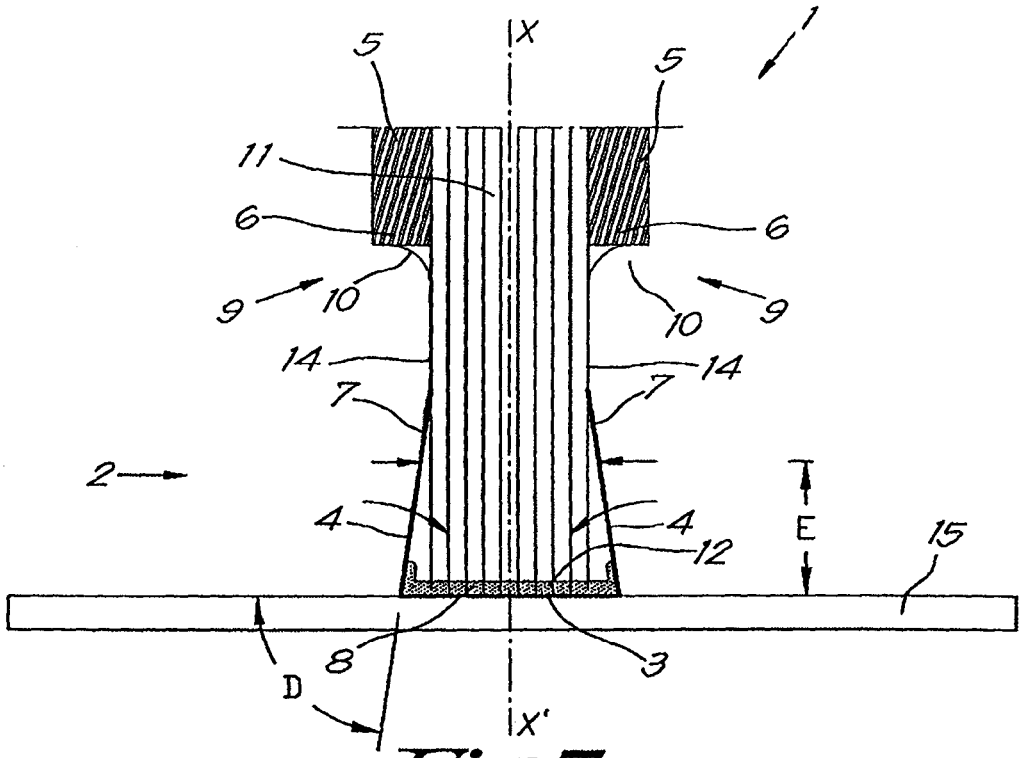

In a next step of the method according to the invention, as illustrated in FIG. 5, the binding element 1 with the bundle 11 therein and the adhesive 8 in the molten state, with the base 3 placed on a close fitting unheated flat seat 15 and a force is exerted on either side of the back 2 in order to fold the arms 4 of the back 2 towards one another in a symmetrical way with respect to the plane of symmetry X-X' of the back, which runs parallel to the arms 4, whereby the arms 4 with the base 3 of the back 2 enclose the same symmetrical angle D as illustrated on the basis of FIG. 5.

Figure 6:
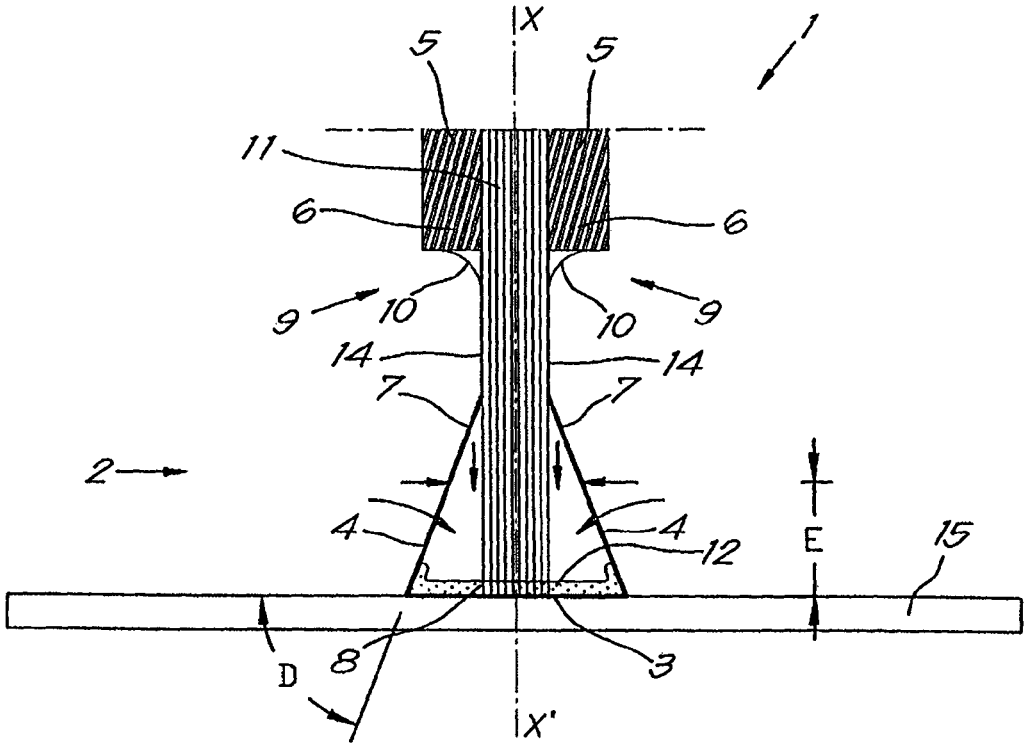

In a next step, as shown in FIG. 6, the arms 4 are moved further towards one another until the aforementioned force has reached a desired value.

It is clear that due to the downward movement of the free ends 7 of the arms 4 in the direction of the base 3 of the back 2, a force is exerted in this direction that pushes the bundle 11, in particular the outermost leaves 14 of the bundle 11, deeper into the molten adhesive 8, helped by the fact that due to this movement of the free ends 7 of the arms 4 of the back 2, the cover sheets 5 of the binding element 1 are pulled in the direction of the molten adhesive 8 on the base 3 of the back 2.

The forces exerted on the arms 4 are preferably equal over the entire length of the back 2 and such that the arms 4, when folding, do not or practically do not deform, and in other words remain flat.

According to a practical application, the aforementioned forces, as shown, are exerted in a direction that is parallel to the flat seat 15 and this at a perpendicular distance from the seat E that corresponds to two thirds of the height F of the arms 4 of the back 2.

If necessary the aforementioned forces are maintained for a short period in order to give the molten adhesive 8 time to at least partially solidify, after which the forces are removed and the bundle 11 is thus firmly bound in the binding element 1 in a professional way, whereby all leaves of the bundle 11, in particular the outermost leaves 14, are secured sufficiently deeply in the solidified adhesive 8, as illustrated in FIG. 6.

Figure 7:
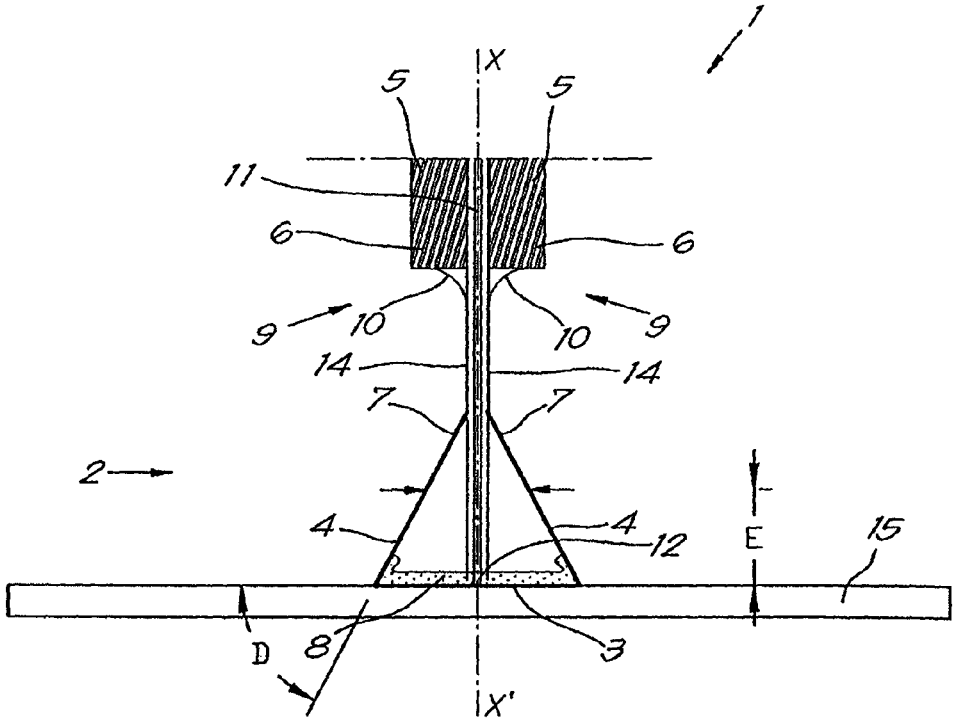
FIG. 7 is an illustration of the last step of the aforementioned method as shown in FIG. 6, but this for binding a thinner bundle.

FIG. 7 shows the last step of the method, analogous to the step shown in FIG. 6, but this for a thinner bundle 11 of only a few loose leaves.

Hereby the arms 4 of the back 2 are analogously bent as in the case of a thicker bundle 11, with the application of the same forces, so that no other adjustment of these forces is required than in the case of the thicker bundle 11.

Preferably the height F of the arms 4 of the back 2 are such that the free ends 7 of the arms 4 can be folded against one another when they are pressed together symmetrically in the aforementioned way.

In this way it is possible, with the oversized binding element 1, even to bind only a single loose leaf in the binding element 1 and nonetheless to be certain that this leaf is bonded deeply enough in the adhesive.

The height F of the arms 4 is thereby preferably such that, when the free ends 7 of the arms 4 are folded up to against one another, the aforementioned angle D that is enclosed with the seat 15 is not less than 45°, such that this prevents the arms 4, upon application of a horizontal force, from deforming and thus the end result of the bound binding element 1 leaving something to be desired.

This aspect of the binding element 1 can be translated mathematically by stating that the height F of the arms 4 may not be less than half the width G of the back 2, multiplied by the square root of two.

FIG. 8 shows a practical embodiment of a binding device 16 according to the invention that enables the method described above to be applied to a binding element 1 according to the invention.

The binding device 16 is equipped in a usual way with a heating element 13 to melt the hot-melt adhesive 8 in the back 2.

Furthermore, the binding device 16 according to the invention is provided with a seat 15 for supporting the base 2 of the back of a binding element 1 to be bound that has this base 2 placed on the seat 15, as shown in FIG. 10.

The form of a seat 15 is preferably such that the base 3 of the back 2 is well supported over its entire length and width G.

The binding device 16 also contains two parallel pressure bars 17 that extend on either side of the seat 15 and above the level of the seat 15, the ends of which are provided with flat protrusions 18 that are held, while be able to slide but not rotate, in a guide 19 of a housing of the binding device 16 not shown, and this guide is shown in dotted lines in FIG. 9, and which in the example concerned extends parallel to the seat 15.

The binding device 16 is equipped with means 20 to move the pressure bars 17 towards one another with a certain force, and these means 20 in this case are formed by a gear rack 21 at each end of the pressure bars 17 and gearwheels 22 meshed with it, which for each pressure bar 17, are mounted on a common shaft 23 that extends along the longitudinal direction of the pressure bars 17.

The aforementioned gearwheels 22 are identical to one another whereby the two gearwheels 22 at the same end of the pressure bars 17 mesh with one another, such that an angular displacement of one gearwheel 22 in a certain direction of rotation causes an equal but contrary angular displacement of the other gearwheel, all such that through this movement the pressure bars 17 move simultaneously and symmetrically with respect to the central perpendicular plane of the aforementioned seat 15.

One of the aforementioned gearwheels 22 is driven by a drive gearwheel 24, which itself, via a system of other gearwheels, is driven by a motor 25 that can be driven in two directions.

The motor 25 is equipped with means 26 that enable the force to be determined that is exerted by the pressure bars 17 on the arms 4 of the back 2, and these means 26 can be formed for example by an ammeter for measuring the current received by the motor 25 and which is a measure of the force exerted.

The aforementioned means 20 also enable the pressure bars 17 to move away from one another again, as a function of a control signal generated by a controller 27 when the said force has reached a desired set value, possibly after this force has been maintained for a short period.

The sides of the pressure bars oriented towards one another are provided with a cylindrical profile 28 oriented towards the inside whose geometric axis 29 is a perpendicular distance E from the aforementioned seat 15, which preferably corresponds to around two thirds of the height F of the arms 4 of the back 2 of the binding element 1.

The operation of the binding device 1 is very simple and as follows.

The binding element 1 with the bundle of loose leaves 11 to be bound is placed with the base 3 of the back 2 on the heating element 13 to melt the hot-melt adhesive 8.

Figure 11:
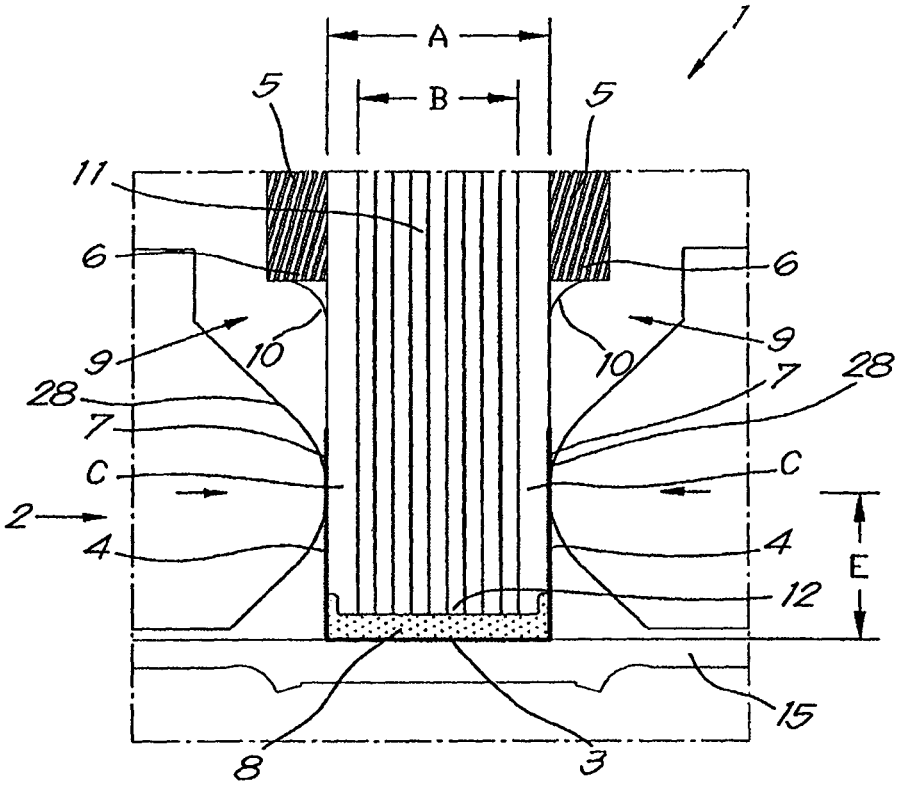
Figure 12:
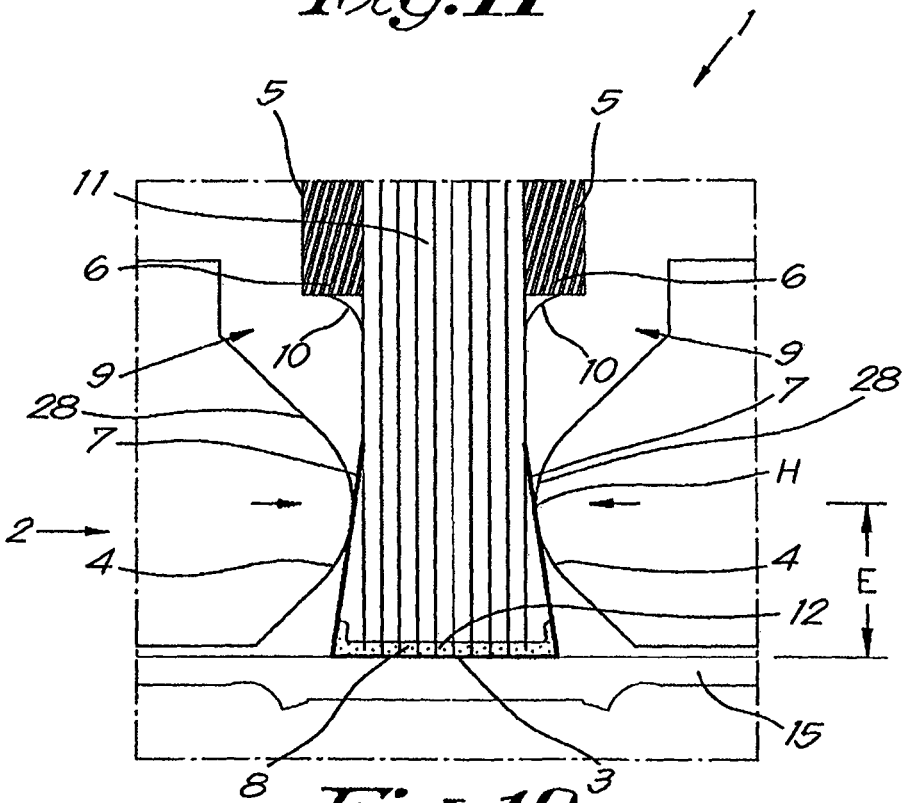
Figure 13:
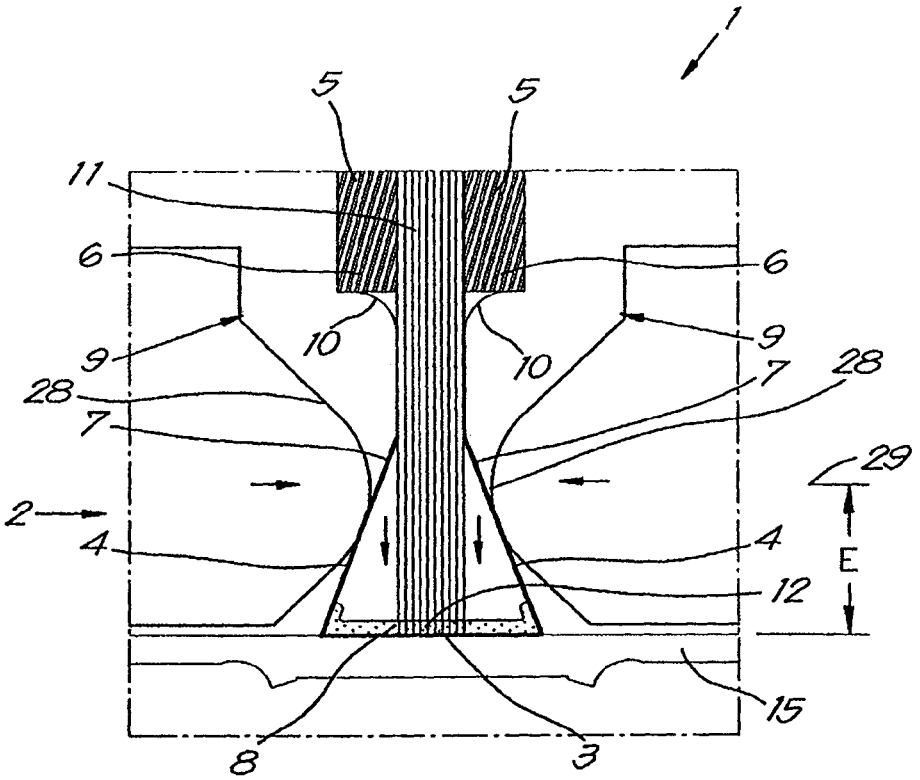
Figure 14:
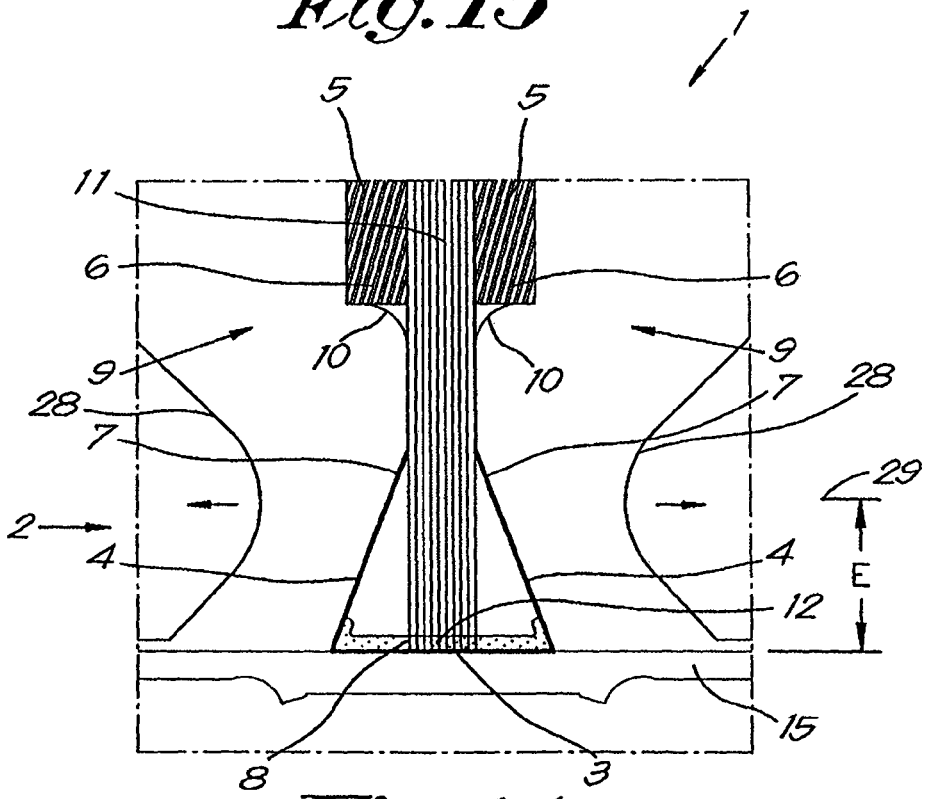

When the adhesive 8 has melted, the binding element 1 is placed with the base 3 of the back 2 on the seat 15 and the motor 25 is driven in a suitable direction to move the pressure bars 17 towards one another, as shown in FIG. 10, until the arms 4 of the back 2 are clasped, as shown in FIG. 11, and further to fold the arms 4 towards one another, as shown in FIG. 12, until the time that the measured current has reached the set value, as shown in FIG. 13, after which, possibly after a short period of a few seconds, the motor 25 is driven in the contrary direction to move the pressure bars 17 away from one another, in so doing to remove the finished binding element 1 from the binding device 16.

The profiled form of the sides of the pressure bars 17 oriented towards one another is such that the local contact point H of the pressure bars 17 on the arms 4 of the back 2 is practically invariable, such that the covering 10 of the back 2 cannot be damaged by the frictional forces that could otherwise arise between the arms 4 and the pressure bars 17.

Alternatively with respect to the example shown, these profiles can be constructed as rollers that are fastened at the aforementioned ⅔ height of the arms 4 to the pressure bars 17 and are freely rotatable around an axis parallel to the longitudinal direction of the pressure bars 17, such that all friction is ruled out.

It is clear that the forces exerted by the pressure bars 17 on the arms 4 of the back 2 do not necessarily have to be parallel to the seat 15, but that these forces can also have a component that is oriented towards the seat 15 in order to secure the binding element 1 firmly on the seat 15.

For the rest it is not necessary for the pressure bars 17 to make a sliding movement, but it is also possible for the pressure bars 17 to be mounted in a pivotable way around an axis that extends parallel to the pressure bar 17.

The present invention is by no means limited to the embodiment described as an example and shown in the drawings, but a binding element and binding device according to the invention can be realised in all kinds of variants and dimensions, without departing from the scope of the invention.

The invention claimed is:

1. Method for binding a bundle of leaves (11) in a binding element (1) in the form of a folder with a U-shaped back (2) of a pliable and thermally conductive material, with a base (3) and two upright arms (4) and two cover sheets (5) that are each connected by an edge (6) to a free edge (7) of the arms, wherein a hot-melt adhesive (8) is provided on the inside of the back (2), at least on a part of the base (3), wherein the bundle of leaves (11) is introduced with the edge to be bound (12) against the hot-melt adhesive (8) in the back (2), and then heating up the back (2) to melt the hot-melt adhesive (8), wherein an oversized binding element (1) is chosen in which the bundle (11) with the thickness (B) of the edge (12) to be bound is received with a certain sideways play (C) between the arms (4) of the back (2), and the binding element (1) with the bundle (11) therein and the hot-melt adhesive (8) in the molten state, is placed with the base (3) of the back (2) on a seat (15) that fits closely to the base (2) with the arms (4) between two parallel pressure bars (17) that are moved towards one another with a force in order to press the base (3) of the back (2) against the seat (15) and at the same time to fold the arms (4) symmetrically towards one another at an angle (D) with respect to the base (3) until the bundle (11), with a desired force from the pressure bars (17), is clamped in between the arms (4) of the back (2), after which the pressure bars (17) are again moved away from one another in order to be able to remove the finished binding element (1) with the bound bundle (11), and wherein the desired force is chosen such that by clamping in the bundle (11) a force is exerted on the bundle (11) that is directed towards the base (3) of the back (2).

2. Method according to claim 1, wherein the base (3) of the back (2) and the seat (15) that fits closely to the base (3) of the back (2) are flat and the pressure bars (17) are moved towards one another along a direction parallel to the aforementioned seat (15).

3. Method according to claim 2, wherein the aforementioned desired value of the forces exerted by the pressure bars (17) on the arms (4) is chosen such that the arms (4) of the back (2) remain primarily flat.

4. Method according to claim 1, wherein the forces exerted by the pressure bars (17) on the arms (4) of the back (2) locally grip at around two thirds of the height (F) of the upright arms (4) of the back (2).

5. Method according to claim 1, wherein the pliable and thermally conductive material is steel.

6. A binding device utilizing the method according to claim 1 for binding a bundle of loose leaves (11) in a binding element (1), wherein the device (1) is provided with a seat (15) for the close-fitting support of the base (3) of the back (2) of the binding element (1) that is placed with this base (3) on the seat (15); two parallel pressure bars (17) that extend on either side of the seat (15) and above the level of the seat (15), and means (20) for moving the pressure bars (17) towards one another with a certain force in order to fold the arms (4) of the back (2) of the binding element (1) on the seat (15) towards one another symmetrically at an angle (D) with respect to the base (3) until the bundle (11), with a desired force from the pressure bars (17), is clamped in between the arms (4) of the back (2); means (26) for determining the force exerted by the pressure bars (17) and means (20) to again move the pressure bars (17) away from one another when the thus determined force has reached a certain desired value, wherein the desired force is chosen such that by clamping in the bundle (11) a force is exerted on the bundle (11) that is directed towards the base (3) of the back (2).

7. Binding device according to claim 6, wherein the seat (15) is a flat seat and the pressure bars (17) are affixed, while being able to slide, in guides (19) that extend parallel to the seat, wherein each pressure bar (17) is equipped with a gear rack (21) and each of the pressure bars (17) is movable in an aforementioned guide (19) by means of a gearwheel (22) that meshes with the aforementioned gear rack (21) of the pressure bar (17) concerned, wherein the gearwheels (22) of both pressure bars (17) are constructed identically and these gearwheels (22) mesh together.

8. Binding device according to claim 7, wherein each pressure bar (17) is equipped at both ends with a gear rack (21) and a gearwheel (22) that meshes with it, wherein the gearwheels (22) are connected together at the ends of one pressure bar (17) by the same shaft (23) that is parallel to the pressure bars (17).

9. Binding device according to claim 8, wherein one of the two gearwheels (22) is driven by a drive gearwheel (24), itself driven by a drive motor (25) that is drivable in the one or the other direction in order to move the pressure bars (17) to or from one another.

10. Binding device according to claim 8, wherein the sides of the pressure bars (17) oriented towards one another are provided with a cylindrical profile (28) oriented to the inside whose geometric axis (29) is at a perpendicular distance (E) from the aforementioned seat (15).

11. Binding device according to claim 7, wherein one of the two gearwheels (22) is driven by a drive gearwheel (24), itself driven by a drive motor (25) that is drivable in the one or the other direction in order to move the pressure bars (17) to or from one another, and wherein the means (26) for determining the force exerted by the pressure bars (17) are formed by an ammeter for measuring the current that is taken by the motor (25), and which is a measure of the force exerted.

12. Binding device according to claim 7, wherein the sides of the pressure bars (17) oriented towards one another are provided with a cylindrical profile (28) oriented to the inside whose geometric axis (29) is at a perpendicular distance (E) from the aforementioned seat (15).

13. Binding device according to claim 12, wherein the aforementioned distance (E) of the geometric shaft (29) from the seat (15) corresponds to approximately two thirds of the height (F) of the arms (4) of the back (2) of the binding element (1).

14. Binding device according to claim 7, wherein the device (16) is equipped with a heating element (13) for heating the back (2) in order to melt the hot-melt adhesive (8) in the back (2).

15. Binding device according to claim 6, wherein the device (16) is equipped with a heating element (13) for heating the back (2) in order to melt the hot-melt adhesive (8) in the back (2).

* * * * *